US008596339B2

(12) United States Patent
Palanchon

(10) Patent No.: US 8,596,339 B2
(45) Date of Patent: Dec. 3, 2013

(54) U-FLOW STACKED PLATE HEAT EXCHANGER

(75) Inventor: Hervé Palanchon, Cologne (DE)

(73) Assignee: Dana Canada Corporation, Oakville, Ontario (CA)

( * ) Notice: Subject to any disclaimer, the term of this patent is extended or adjusted under 35 U.S.C. 154(b) by 868 days.

(21) Appl. No.: 12/425,724

(22) Filed: Apr. 17, 2009

(65) Prior Publication Data

US 2009/0260786 A1 Oct. 22, 2009

Related U.S. Application Data

(60) Provisional application No. 61/045,750, filed on Apr. 17, 2008.

(51) Int. Cl.

| | |
|---|---|
| ***F28F 27/02*** | (2006.01) |
| ***F28D 1/02*** | (2006.01) |
| ***F28F 9/02*** | (2006.01) |
| ***F28D 7/06*** | (2006.01) |

(52) U.S. Cl.
USPC ..... 165/103; 165/153; 165/174; 165/176

(58) Field of Classification Search
USPC ..... 165/173, 175, 140, 153, 174, 176, 103
See application file for complete search history.

(56) References Cited

U.S. PATENT DOCUMENTS

| | | | | | |
|---|---|---|---|---|---|
| 3,017,161 | A | * | 1/1962 | Slaasted et al. | 165/166 |
| 4,002,201 | A | * | 1/1977 | Donaldson | 165/140 |
| 4,081,025 | A | * | 3/1978 | Donaldson | 165/153 |
| 4,258,785 | A | * | 3/1981 | Beldam | 165/153 |
| 4,274,482 | A | * | 6/1981 | Sonoda | 165/153 |
| 4,461,348 | A | * | 7/1984 | Toge et al. | 165/173 |
| 4,546,823 | A | * | 10/1985 | Melnyk | 165/149 |
| 4,645,002 | A | * | 2/1987 | Keyzer | 165/175 |
| 4,651,815 | A | * | 3/1987 | Logic et al. | 165/173 |
| 4,971,145 | A | * | 11/1990 | Lyon | 165/173 |
| 4,987,955 | A | * | 1/1991 | Bergqvist et al. | 165/166 |
| 5,062,477 | A | | 11/1991 | Kadle | |
| 5,172,759 | A | | 12/1992 | Shimoya et al. | |
| 5,186,246 | A | * | 2/1993 | Halstead | 165/140 |

(Continued)

FOREIGN PATENT DOCUMENTS

WO WO2006084867 A1 8/2006

OTHER PUBLICATIONS

Current plate-type cooler (Modine), attached.

*Primary Examiner* — Ljiljana Ciric
(74) *Attorney, Agent, or Firm* — Ridout & Maybee LLP

(57) ABSTRACT

A manifold structure is defined by a pair of stacked plates which define a void: one of these plates has three or more aperture-surrounding bosses which project into the void; the other of these plates has a plurality of protuberances. Each of the protuberances engages between a respective pair of the bosses. A heat exchange element is formed of a plurality of stacked plates, these plates defining a stack of tubes. The tube stack interiorly defines a plurality of U-shaped passages, these passages being distinct from one another. Each tube defines a respective one of the U-shaped passages and is received in plug-fit relation by a respective one of the bosses. The tubes, bosses and protuberances separate the void into a pair of manifolds. Each of the U-shaped passages leads from one of the manifolds to the other of the manifolds.

10 Claims, 16 Drawing Sheets

(56) References Cited

U.S. PATENT DOCUMENTS

| | | | | |
|---|---|---|---|---|
| 5,195,579 | A * | 3/1993 | Buchanan | 165/149 |
| 5,332,032 | A * | 7/1994 | Beddome et al. | 165/153 |
| 5,366,008 | A * | 11/1994 | Kadle et al. | 165/173 |
| 5,381,858 | A * | 1/1995 | Fredrich | 165/150 |
| 5,390,733 | A * | 2/1995 | Young | 165/173 |
| 5,538,077 | A * | 7/1996 | So et al. | 165/153 |
| 5,758,721 | A * | 6/1998 | Letrange et al. | 165/173 |
| 5,794,691 | A * | 8/1998 | Evans et al. | 165/153 |
| 5,884,696 | A * | 3/1999 | Loup | 165/140 |
| 5,918,664 | A * | 7/1999 | Torigoe | 165/153 |
| 5,944,095 | A * | 8/1999 | Fukuoka et al. | 165/173 |
| 5,950,715 | A * | 9/1999 | Jonsson et al. | 165/103 |
| 6,082,446 | A * | 7/2000 | Ahaus et al. | 165/173 |
| 6,170,567 | B1 * | 1/2001 | Nakada et al. | 165/153 |
| 6,182,749 | B1 * | 2/2001 | Brost et al. | 165/103 |
| 6,189,606 | B1 * | 2/2001 | Chevallier | 165/173 |
| 6,216,777 | B1 * | 4/2001 | Rhodes et al. | 165/176 |
| 6,241,011 | B1 * | 6/2001 | Nakamura et al. | 165/153 |
| 6,263,570 | B1 * | 7/2001 | Cazacu | 165/173 |
| 6,302,196 | B1 * | 10/2001 | Haussmann | 165/153 |
| 6,305,466 | B1 * | 10/2001 | Andersson et al. | 165/140 |
| 6,332,495 | B1 * | 12/2001 | Jamison et al. | 165/153 |
| 6,341,649 | B1 * | 1/2002 | Joshi et al. | 165/153 |
| 6,530,424 | B2 * | 3/2003 | Jamison et al. | 165/153 |
| 6,786,275 | B2 * | 9/2004 | Dey et al. | 165/173 |
| 6,807,955 | B2 | 10/2004 | Leedham et al. | |
| 6,868,696 | B2 * | 3/2005 | Ikuta | 165/153 |
| 6,976,480 | B2 | 12/2005 | Miyoshi et al. | |
| 7,013,952 | B2 * | 3/2006 | Park et al. | 165/176 |
| 7,032,577 | B2 * | 4/2006 | Rosin et al. | 165/103 |
| 7,036,565 | B2 * | 5/2006 | Brost et al. | 165/103 |
| 7,051,799 | B2 | 5/2006 | Wu et al. | |
| 7,121,329 | B2 * | 10/2006 | Shields et al. | 165/173 |
| 7,168,419 | B2 * | 1/2007 | Rosin et al. | 165/103 |
| 7,198,037 | B2 * | 4/2007 | Sayers et al. | 123/568.12 |
| 7,207,324 | B2 | 4/2007 | Kuhnel et al. | |
| 7,207,378 | B2 * | 4/2007 | Kroetsch et al. | 165/153 |
| 7,234,453 | B2 | 6/2007 | Gallino et al. | |
| 7,243,707 | B2 * | 7/2007 | Brost et al. | 165/103 |
| 7,337,833 | B2 * | 3/2008 | Laveran et al. | 165/153 |
| 7,341,098 | B2 * | 3/2008 | Brost et al. | 165/153 |
| 7,363,919 | B1 | 4/2008 | Styles | |
| 7,487,826 | B2 * | 2/2009 | Pineo et al. | 165/173 |
| 7,610,949 | B2 * | 11/2009 | Palanchon | 165/103 |
| 7,661,415 | B2 * | 2/2010 | Nakamura | 123/568.12 |
| 7,703,505 | B2 * | 4/2010 | So et al. | 165/153 |
| 7,900,610 | B2 * | 3/2011 | Okawa et al. | 123/568.12 |
| 7,946,339 | B2 * | 5/2011 | So et al. | 165/140 |
| 7,984,753 | B2 * | 7/2011 | Ohfune et al. | 165/157 |
| 8,011,422 | B2 * | 9/2011 | Yamazaki et al. | 165/103 |
| 8,181,694 | B2 * | 5/2012 | Powers et al. | 165/175 |
| 8,191,615 | B2 * | 6/2012 | So et al. | 165/140 |
| 8,322,407 | B2 * | 12/2012 | Reynolds | 165/173 |
| 8,365,813 | B2 * | 2/2013 | Mercz et al. | 165/100 |
| 8,371,365 | B2 * | 2/2013 | Kesseli et al. | 165/153 |
| 2004/0069441 | A1 * | 4/2004 | Burgers et al. | 165/41 |
| 2005/0199381 | A1 | 9/2005 | Mercz | |
| 2006/0032613 | A1 * | 2/2006 | Brost et al. | 165/103 |
| 2006/0124114 | A1 * | 6/2006 | Sayers et al. | 165/103 |
| 2006/0288694 | A1 | 12/2006 | Hayashi | |

* cited by examiner

U-FLOW STACKED PLATE HEAT EXCHANGER

This application incorporates by reference and claims the benefit of the filing date of and right of priority of U.S. Provisional Patent Application Ser. No. 61/045,750 filed Apr. 17, 2008 under 35 USC §119(e).

BACKGROUND OF THE INVENTION

1. Field of the Invention

The invention pertains to the exchange of heat between two fluids.

2. Background Art

Motor vehicles with internal combustion engines are sometimes equipped with an exhaust gas cooler or element in the exhaust system of the vehicle to permit cooling and/or recirculation of exhaust gas under certain operating conditions.

SUMMARY OF THE INVENTION

Forming one aspect of the invention is a heat exchanger comprising a manifold structure and a heat exchange element. The manifold structure is defined by a pair of stacked plates which define a void, one of the pair of stacked plates having three or more aperture-surrounding bosses which project into the void and the other of the pair of stacked plates having a plurality of protuberances, each of said protuberances engaging between a respective pair of the three or more aperture-surrounding bosses, the bosses in said respective pair being adjacent to one another. The heat exchange element is formed of a plurality of stacked plates, the plurality of stacked plates defining a stack of tubes which stack interiorly defines a first plurality of U-shaped passages, the passages of said plurality of U-shaped passages being distinct from one another, each of said tubes defining a respective one of the U-shaped passages, each tube being received in plug-fit relation by a respective one of the aperture-defining bosses so that the tubes, the bosses and the protuberances separate the void into a pair of manifolds and so that each of the first plurality of U-shaped passages leads from one of the manifolds of the pair of manifolds to the other of the manifolds of the pair of manifolds.

According to another aspect of the invention, the heat exchanger can form part of a heat exchange assembly. In addition to the heat exchanger, the heat exchange assembly includes a housing element having a first portion defining an open socket. In the heat exchange assembly, the pair of manifolds are disposed outside the open socket and the heat exchange element is being fitted within the open socket.

According to another aspect of the invention, in the heat exchange assembly, the housing element can have a second portion defining a valve housing having an inlet and an outlet and a pair of ports and the plurality of stacked plates can define, in combination with the first portion of the housing element, a second plurality of U-shaped passages interleaved between the first plurality of U-shaped passages, each of the second plurality of U-shaped passages leading from the one of the ports, into the open socket and back to the other of the ports.

According to another aspect of the invention, in the heat exchange assembly, there can be provided a valve body movable between a bypass position, wherein fluids introduced into the inlet pass directly to the outlet, and an active position, wherein fluids introduced are directed past the heat exchange element.

According to another aspect of the invention, in the heat exchange assembly: the one of the pair of stacked plates can have a pair of outer bosses which bosses project from the void, each of the bosses of the pair of outer bosses leading into a respective one of the manifolds; the pair of stacked plates and the plurality of stacked plates can have peripheral planar sections which can be stacked together to define a the housing element; and the other of the pair of stacked plates can have a central hollow in which the protuberances (100) are formed.

According to yet another aspect of the invention, the heat exchanger can be an exhaust gas cooler.

According to another aspect, the heat exchanger can comprise: (a) a plurality of stacked tubular members defining a first set of flow passages for a first fluid through the tubular members and a second set of flow passages for a second fluid between adjacent tubular members, and (b) a tank connected to a first end of the stacked tubular members, the tank defining inlet and outlet manifolds in communication with inlet and outlet openings, respectively of the first set of flow passages for distributing the first fluid to and collecting the first fluid from the first set of flow passages, the tank defining a plurality of wall portions each having a first side facing at least one of the inlet and outlet manifolds and an opposite side facing a respective one of the second set of flow passages such that the wall portions provide heat exchanger interfaces between the first and second fluids.

BRIEF DESCRIPTION OF THE DRAWINGS

Exemplary embodiments of the invention will now be described, by way of example, with reference to the accompanying drawings, in which.

DETAILED DESCRIPTION OF EXAMPLE EMBODIMENTS

Figure 1:
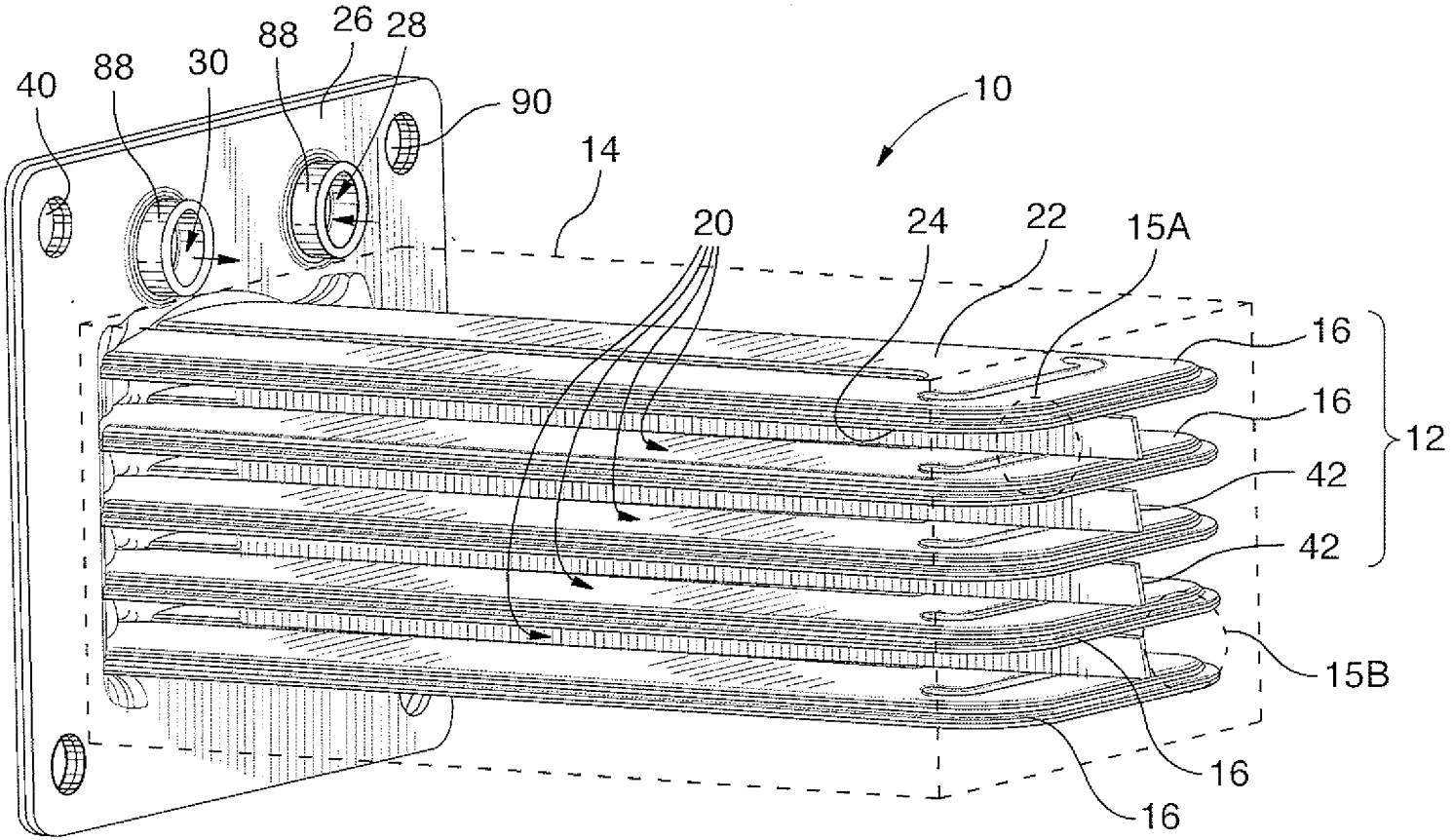
FIG. 1 is a perspective view of an exemplary embodiment of a heat exchanger according to the present invention.
Figure 2:
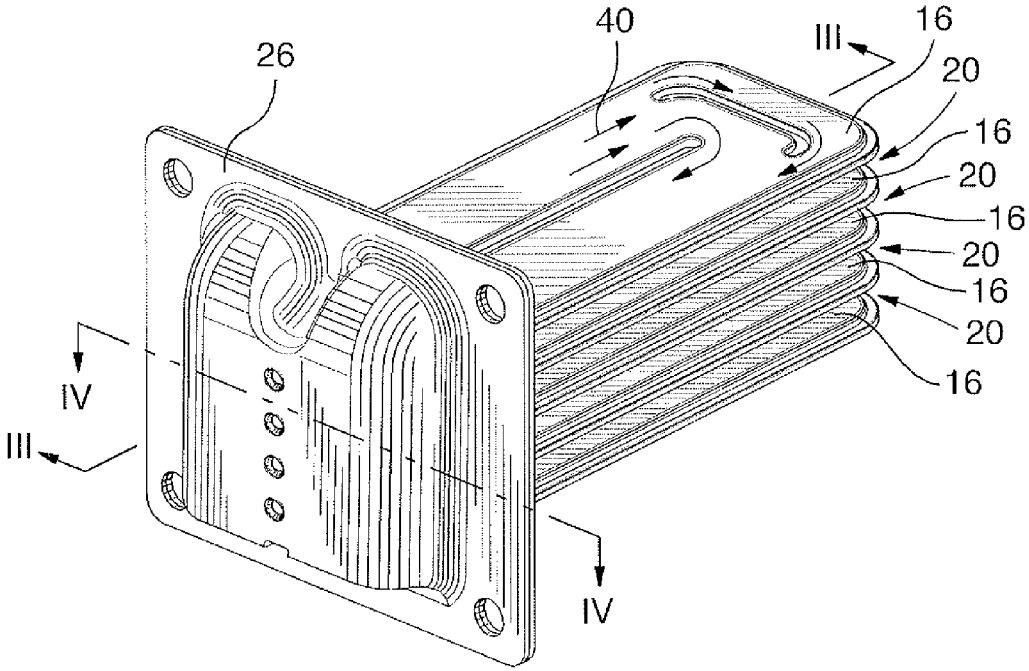
FIG. 2 is a further perspective view of the heat exchanger of FIG. 1.

Referring to the drawings, there is shown in FIG. 1 a heat exchanger 10 according to an exemplary embodiment of the invention. Heat exchanger 10 is comprised of a core portion 12 formed by a plurality of stacked tubular members 16 which define a first set of generally U-shaped flow passages 18 (see FIGS. 3 and 5) for the flow of a first fluid, such as a coolant, through the heat exchanger 10. A second set of generally U-shaped flow passages 20 is defined between adjacent tubular members 16 for the flow of a second fluid, such as exhaust gas, through the heat exchanger 10. Separating walls 42 are located between adjacent tubular members 16 to separate the parallel paths of the U-shaped flow passages 20. Turbulizers or fins 21 (not shown in FIG. 1, partially shown in FIG. 5) may be located in the second set of flow passages 20 to increase heat exchange. A tank 26 for the first fluid (hereinafter referred to as the coolant for purposes of describing this exemplary embodiment) is provided at a first end of the core 12 of the heat exchanger 110, the tank 26 defining an inlet opening 28 communicating with an inlet manifold 32 (See FIG. 4) and an outlet opening 30 communicating with an outlet manifold 34. The inlet manifolds 32 and 34, which are separated in the tank 26, each respectively communicate with inlet openings 36 and outlet openings 38 of the tubular members 16 (See FIGS. 4 and 13).

In one exemplary embodiment the core 12 functions as a diffuser for cooling the second fluid (hereinafter referred to as the exhaust coolant for purposes of the describing an exemplary embodiment), and is enclosed within a case or chamber 14 that is diagrammatically shown by dashed lines in FIG. 1. The chamber 14 includes a gas inlet 15A and a gas outlet 15B. In the case where heat exchanger 10 is used as an exhaust gas cooler, chamber gas inlet 15A receives exhaust gas from the engine and the chamber gas outlet 15A allows the exhaust gas to be circulated back to the engine air intake or to other components in the exhaust line. In the illustrated embodiment, the gas inlet 15A and outlet 15B are located at the opposite end of the heat exchanger 10 than the coolant inlet and outlet 28, 30 such that the U-shaped coolant flow passages 18 are oriented in an opposite direction than the U-shaped gas flow passages 20.

Coolant flow through the heat exchanger 10 will now be described according to one exemplary embodiment. With reference to FIGS. 1-4, in operation, coolant enters the inlet coolant manifold 32 through the tank inlet 28, flows through in parallel through the flow passages 18 defined by tubular members 16, then back into the outlet coolant manifold 34, and then through tank outlet 30. Arrows 40 in FIG. 2 generally illustrate coolant flow through the generally U-shaped flow passage 18 of a tubular member 16.

Figure 14:
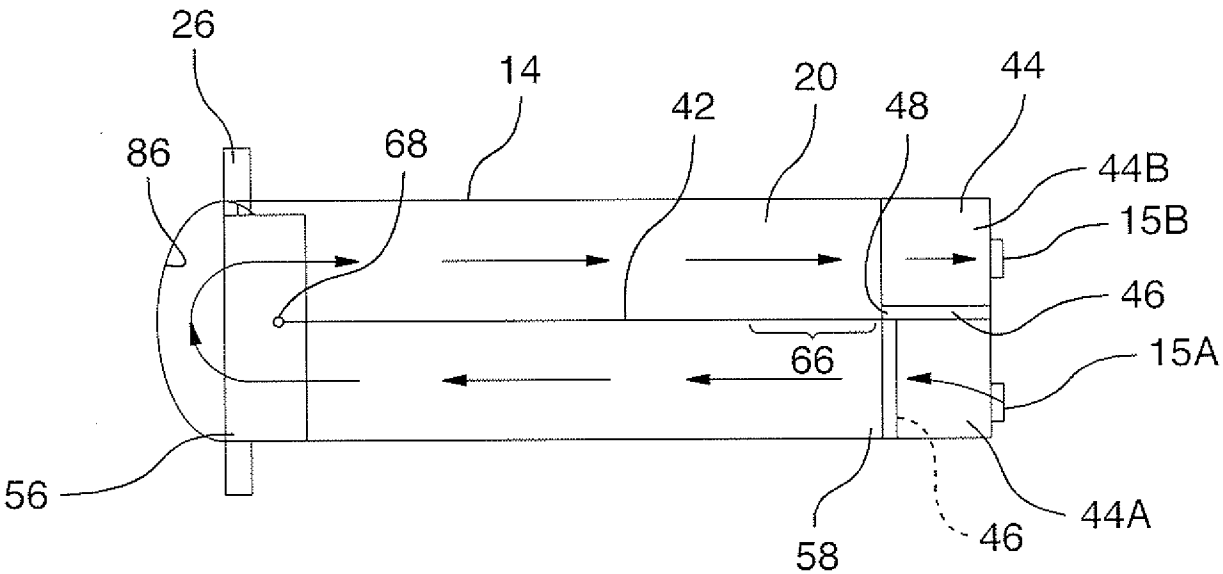
FIG. 14 is diagrammatic sectional plan view illustrating flow of the fluid being cooled through the heat exchanger of FIG. 1.

Turning now to the flow of exhaust gas through the chamber 14, FIG. 14 shows a diagrammatic illustration of exhaust gas flow through one of the gas flow passages 20 that is located between adjacent tubular members 16. In one exemplary embodiment, the chamber 14 defines a manifold 44 at an end of the core 12 that is opposite the end where coolant tank 26 is located. The manifold 44 includes an inlet portion 44A and an outlet portion 44B that each communicates respectively with inlet and outlet openings of the gas flow passages 20 that are formed in the core 12. In one exemplary embodiment, a regulator or diverter flap 46 is provided in the tank 44. The flap 46 is movable about a pivot 48 between a first position, as shown in solid lines in FIG. 14, and a second position as shown in dashed lines in FIG. 14. In the first position, the flow diverter 46 separates the gas manifold 44 into the inlet manifold 44A and the outlet manifold 44B such that in operation, substantially all gas entering the inlet manifold 44A through the inlet 15A will pass through the U-shaped gas flow passages 20 of the core 12 and subsequently into the outlet manifold 44B and out the gas outlet 15B. In the second position, the flow diverter 46 does not separate inlet and outlet manifolds 44A and 44B and blocks the inlets of flow passages 20 such that substantially all of the gas entering manifold 44 through inlet 15A by-passes core 12 and immediately exists through outlet 15B. In exemplary embodiments, the flow diverter 46 can be moved between a number positions between the first and second positions to variably control the flow of exhaust gas through the gas passages 20 of core 12. In some exemplary embodiments, flow diverter 46 is omitted from the gas manifold 44.

Figure 3:
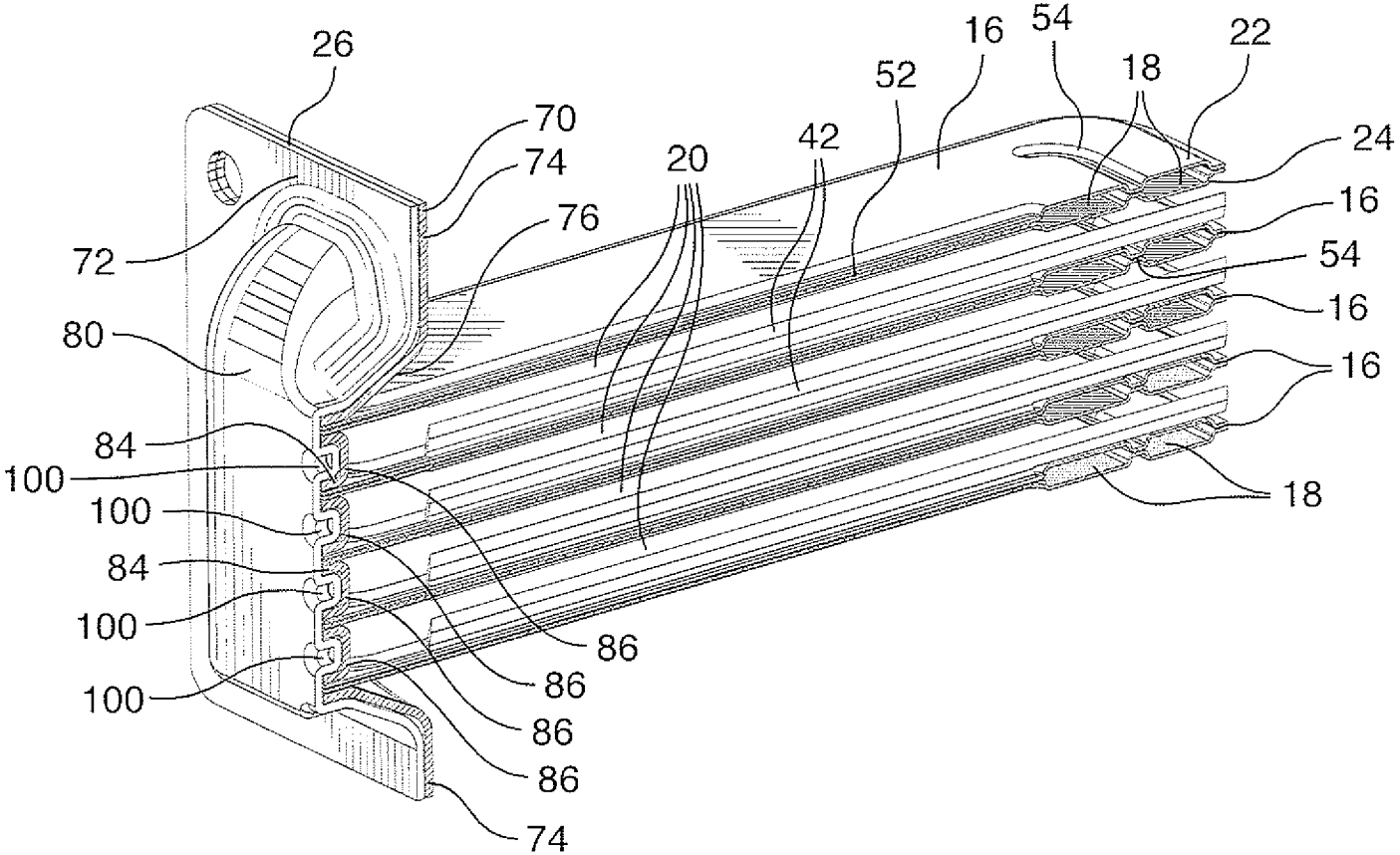
FIG. 3 is a perspective sectional view of the heat exchanger taken along lines III-III of FIG. 2.
Figure 7:
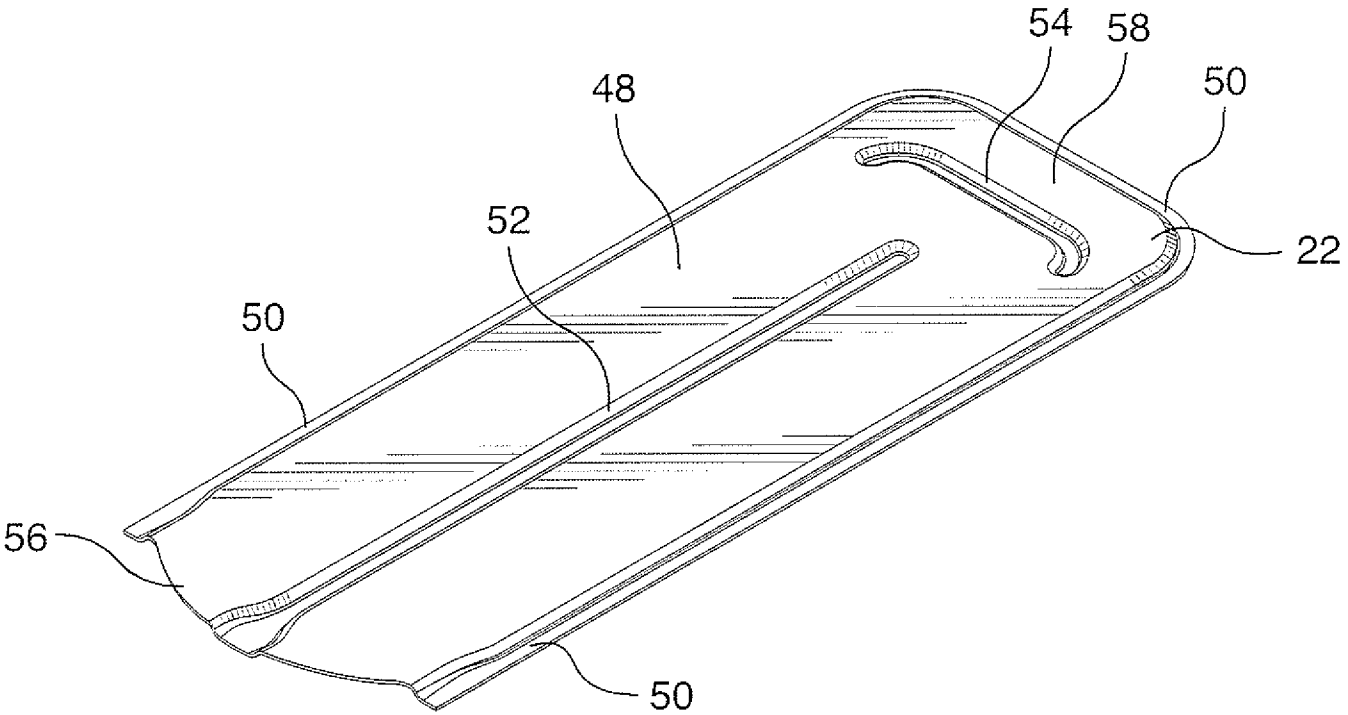
FIGS. 7 and 8 are perspective views of plate used to form tubular members of the heat exchanger of FIG. 1 according to an exemplary embodiment.
Figure 8:
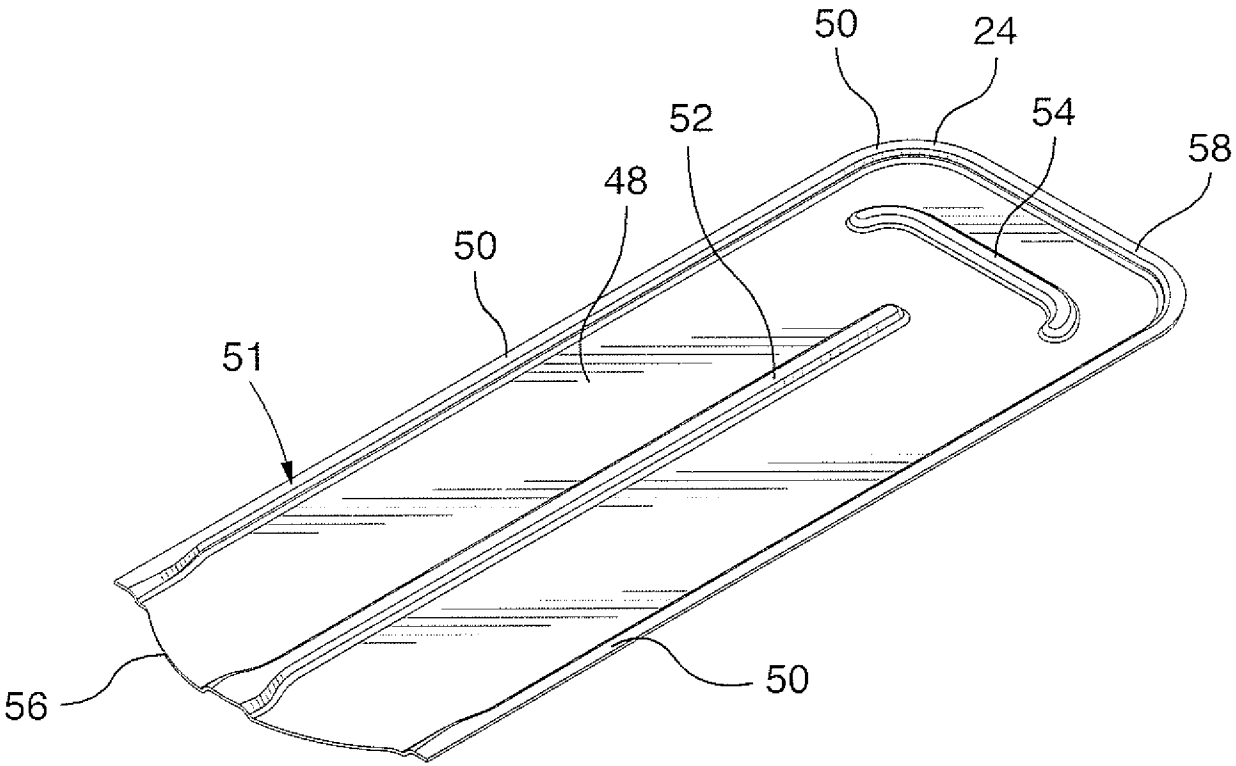

An overview of the heat exchanger 10 and its operation having been provided, the components of the heat exchanger will now be described in greater detail. While tubular members 16 may be formed by a single tubular element, they may also be formed of upper and lower plates 22, 24 and, therefore, may also be referred to as plate pairs. FIGS. 7 and 8 show an example embodiment of upper and lower plates 22, 24, respectively. In one exemplary embodiment, plates 22 and 24 are identical plates where one of the plates of the plate pair is flipped over relative to the other plate. Each plate 22, 24 has a substantially planar central rectangular portion 48 that is surrounded on three sides by a peripheral flange 50 that includes a substantially planar contact surface 51 that is located in a plane inwardly offset from the planar central rectangular portion 48. A central rib 52 is formed in the planar central rectangular portion 48, having an inwardly offset contact surface that is substantially in the same plane as the contact surface 51 of peripheral flange 50. The central rib 52 extends from the peripheral edge of a first end 56 of the plate to a location that is spaced apart from a second end 58 of the plate 22, 24. In at least some exemplary embodiments, a U-shaped rib 54 is formed near the second end 58 of the plate 22, 24, the rib 54 having an inwardly offset contact surface that is substantially in the same plane as the contact surface 51 of peripheral flange 50. In order to form a tubular member 16 a first plate 22 and second plate 24 are secured together in face-to-face fashion with the respective contact surfaces of their respective peripheral flange 50, central rib 52 and U-shaped rib 54 sealingly joined together and their respective central planar portions 48 spaced apart to define U shaped coolant flow passage 18. As seen in FIG. 3, the cooperating U-shaped ribs 54 in a plate pair define two parallel flow paths about the U-turn portion of the coolant flow passage 18.

Figure 13:
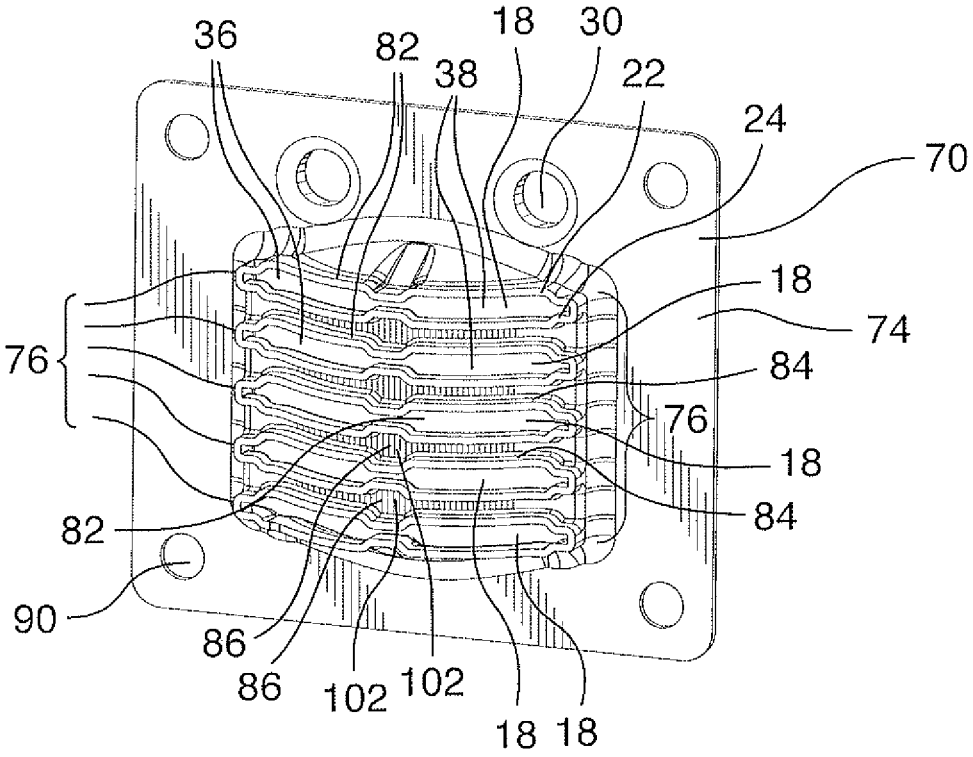
FIG. 13 is a perspective view of part of the first plate of the tank, showing the same side as is shown in FIG. 11, together with ends of tubular members of the heat exchanger.

As seen in FIG. 13, the inlet and outlet openings 36, 38 to passages 18 are defined at the first ends of the plates 22, 24 where the peripheral flange 50 is omitted. In this exemplary embodiment, plates 22, 24 are formed from braze-clad aluminum or aluminum alloy plates, although tubular members 16 can also be formed from other materials including stainless steel, plastic or composite materials for example.

In this exemplary embodiment, the second set of flow passages 20 have turbulizers 21 located therein. The turbulizers are typically formed of expanded metal or any other suitable material to produce undulating flow passages which create mixing or turbulence in the flow thereby increasing heat exchange. As for the first set of flow passages 18, the upper and lower plates 22, 24 may have inwardly disposed, spaced-apart mating dimples or protrusions formed in their central, generally planar portions 48. Such dimples, as well as U-shaped rib 54 can serve to create flow turbulence or mixing within the first set of flow passages 18 to enhance heat exchange, and also maintain the flow channel height and support for planar portions 48, especially during the brazing of heat exchanger 10, as well as add strength to the heat exchanger.

Figure 9:
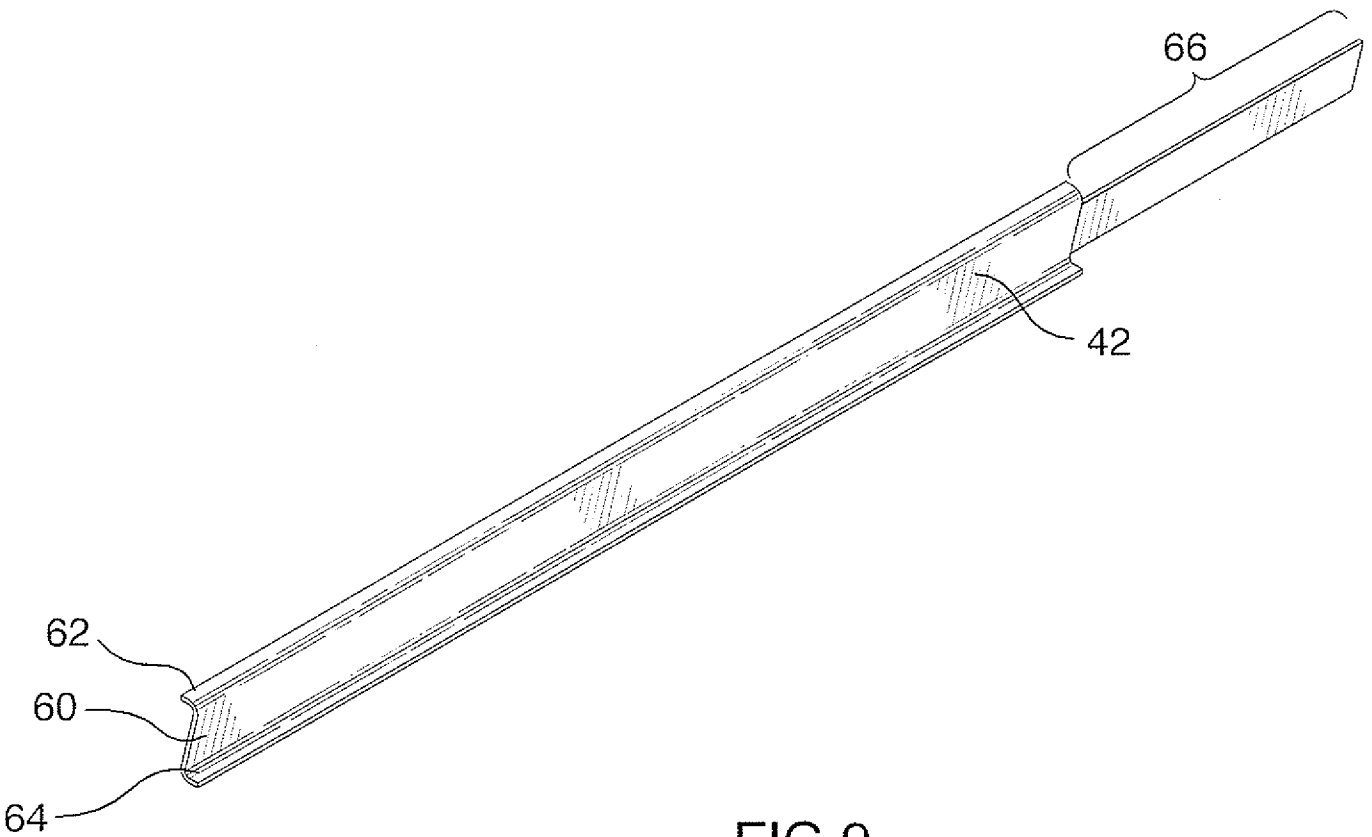
FIG. 9 is a perspective view of a separating wall of the heat exchanger of FIG. 1.

As noted above, separating walls 42 are located between adjacent tubular members 16 to separate the parallel paths of the U-shaped flow passages 20. FIG. 9 shows an exemplary embodiment of a separating wall 42, which as illustrated includes an elongate rectangular substantially planar wall section 60 with a first lateral flange 62 extending in a first direction from a top edge of the wall section 60 and a second lateral flange 64 extending in the opposite direction from a bottom edge of the wall section 60 such that the separating wall 42 has a Z-shaped cross-sectional area along much of its length. As shown in FIG. 9, the first and second flanges start at one end of the wall section 60 but terminate before the second end of the wall section 60 such that an end portion 66 of the wall section 60 is flangeless. When the heat exchanger core 12 is assembled the separating wall 42 is positioned between the outer surfaces of adjacent plates 22, 24 with the first lateral flange 62 being located in the groove provided by central rib 52 in the lower surface of a lower plate 24 in a first tubular member 16 and the second lateral flange 64 being located in the groove provided by central rib 52 in the upper surface of an upper plate in an adjacent second tubular member 16. Thus, in addition to dividing the internal flow passage 18 formed between the plate pair of a tubular member 16, the central ribs 52 also provide locating seats for the separating walls 42 that are located in the flow passages 20 between adjacent pair tubular members 16. As noted above, the central rib 52 on each plate 22, 24 terminates before the second end 58 of the core in order to provide the U-turn in the flow passage 18, and thus the non-flanged portion 66 of the wall section 60 is provided to divide the flow passage 20 where no central ribs 52 exist to receive the upper and lower flanges 62, 64. As illustrated in FIG. 14, each separating wall 42 extends from the second end 58 of the heat exchanger core 12 to a point 68 that is spaced apart from the first end 56 of the core 12, this providing a U-turn region for the exhaust gas at the first end 56 of the core 12 in each of the exhaust gas flow passages 20.

As will now be explained in greater detail, in exemplary embodiments the coolant tank 26, which is located at the first end 56 of the heat exchanger 10, is configured to perform multiple functions, including distributing the coolant, providing a heat exchange surface for cooling and redirecting the exhaust gas, and providing a mounting flange for mounting the heat exchanger core. Combining multiple functions into the coolant tank 26 can in some configurations provide a more compact heat exchanger than would otherwise be possible if multiple functions were not combined.

Figure 5:
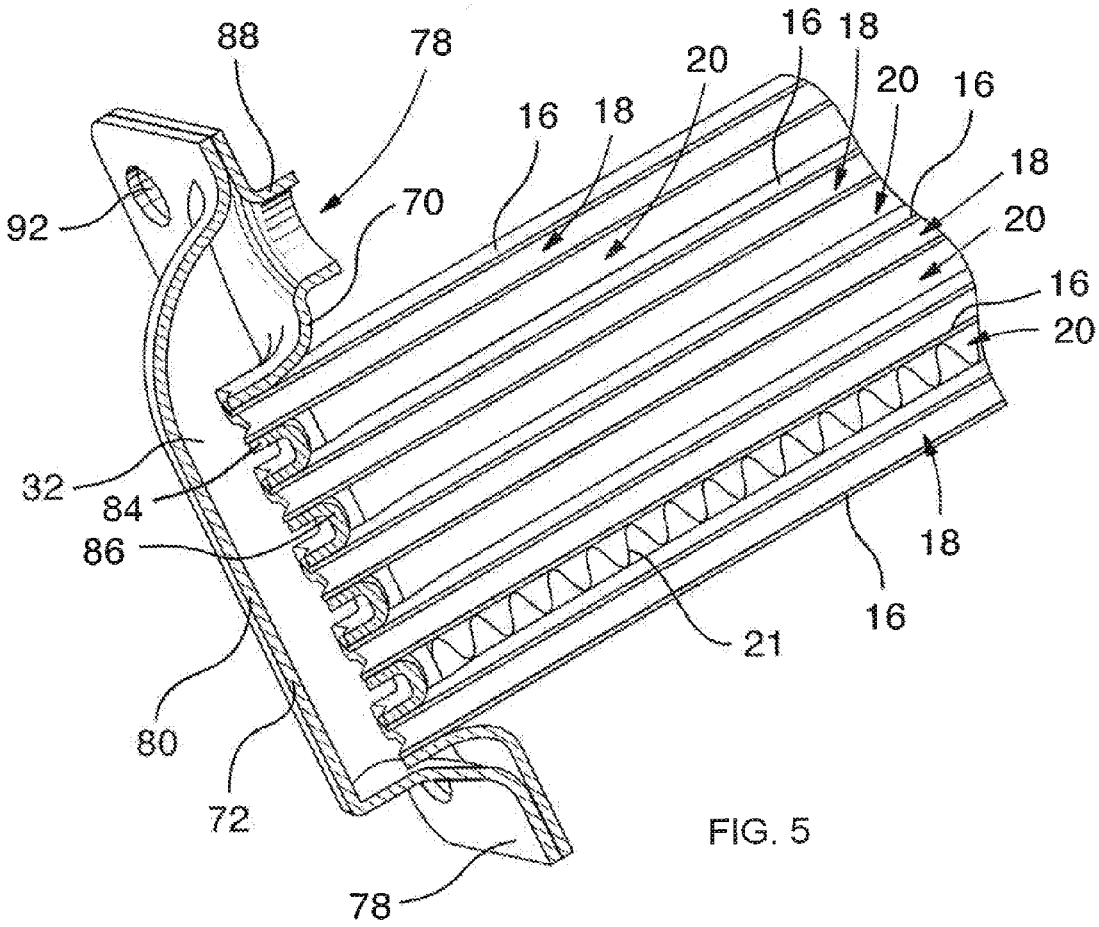
FIGS. 5 and 6 are further sectional views of part of the heat exchanger of FIG. 1.
Figure 6:
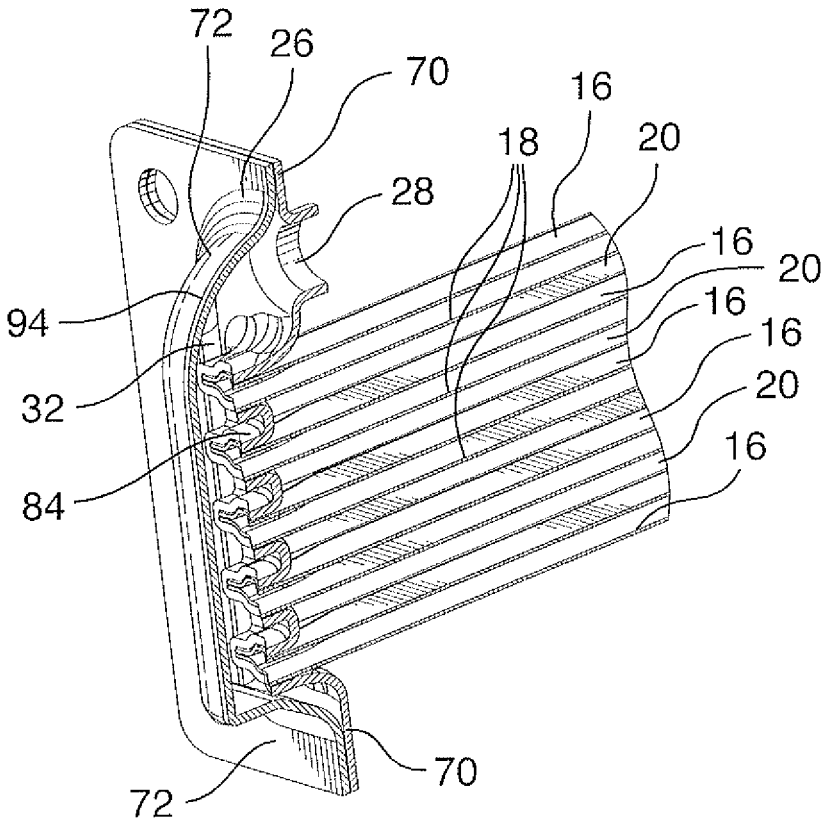

As shown in FIGS. 5 and 6, in one exemplary embodiment the tank 26 includes a first plate 70 and a second plate 72 that define the coolant inlet manifold 32 and the coolant outlet manifold 34 between them, the inlet manifold 32 and the outlet manifold 34 collectively defining a void 35. The first plate 70 is shown in greater detail in FIGS. 11, 12 and 13 and the second plate 72 is shown in greater detail in FIG. 10. The first plate 70 includes a curved central wall portion 76 that is surrounded by a substantially planar peripheral flange 74. The central wall portion 76 defines a stack of elongate parallel slots 82 for receiving and securing the open ends of tubular members 16 to the tank 26. The slots 82 are each surrounded by respective flange 84 that extends inwardly from central wall portion 76 into manifolds 32, 34. Flanges 84 each provide a mating surface around their respective slot 82 for sealingly engaging the end of a respective tubular member 16, as best shown in FIG. 13. As shown in FIG. 13, each slots 82 and flange 84 is formed to match the outer profile of the end of the tubular member 16 that it engages.

The central wall section 76 has an inwardly curved shape such that the exterior surface of the first plate 72 that faces outward to the tubular members 18 defines a series of inwardly curved wall portions 86 between slots 82. As shown in FIG. 3 and illustrated in FIG. 14, these inwardly curved wall portions 86 define the end of the U-turn portion of the gas flow passages 20. Further, as these inwardly curved wall portions 86 have an inner surface in contact with the coolant in the coolant manifolds 32, 34 and an outer surface in contact with the exhaust gas at the turn portion of gas flow passages 20, the curved wall portions 86 provide an additional heat exchange interface between the coolant and the exhaust gas.

As seen in the Figures, the coolant inlet 28 and outlet 30 are formed through the flange 74 of the first plate 70. As shown in FIG. 1, an outwardly extending annular flange 88 is formed around each of the inlet and outlet 28, 30 for insertion into a respective coolant inlet conduit and outlet conduit. O-rings can be provided on annular flanges 88 to facilitate a tight seal. Additionally, bolting or mounting holes 90 are also formed through the flange 74 of the first plate 70. In the illustrated embodiment, four mounting holes 90 are provided, one at each corner region of the flange 74.

Figure 10:
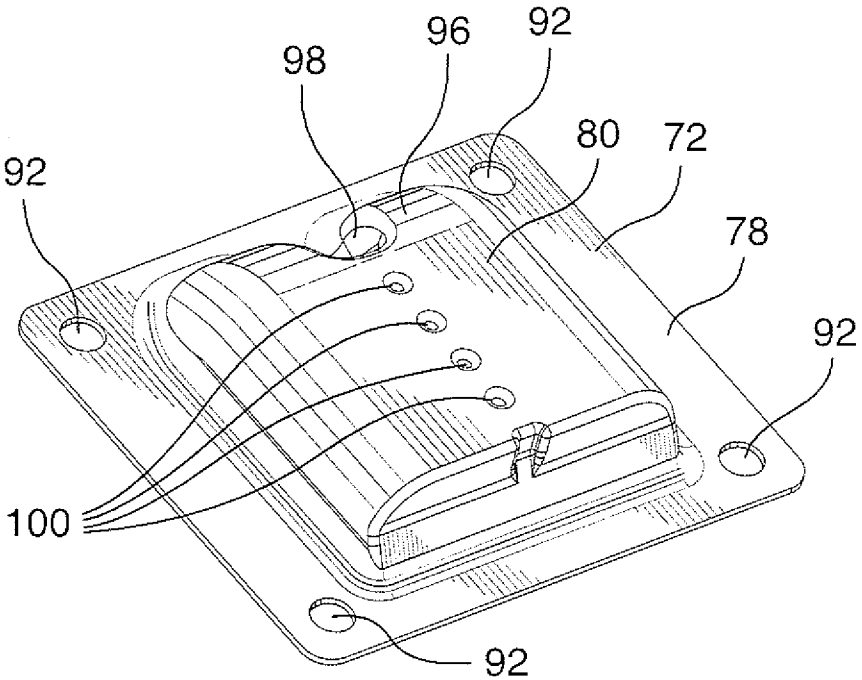
FIG. 10 is a perspective view of a second plate of a tank of the heat exchanger of FIG. 1, showing an outer side of the second plate.

Turning now to the second tank plate 72, as shown best in FIGS. 5 and 10, the second plate 72 includes an outwardly extending central section 80 that is surrounded by an inwardly offset peripheral flange 78 that has bolting or mounting holes 92 formed through it. The first and second tank plates 70 and 72 are configured such that they can be sealably secured together by mating and joining their respective peripheral flanges 74 and 78. When the tank plates 70 and 72 are secured together, inlet and outlet manifolds 32 and 34 are formed between the respective central sections 76, 80 of the plates 70, 72, and the bolting holes 90 through the first plate 70 are each aligned with a respective bolt hole 92 in the second plate 72 such that the tank 26 has integrated mounting holes for securing it in place. As shown in FIG. 10 for example the central section 80 of the second tank plate 72 has first and second upper regions 94 and 96 that are separated by a notch 98 that is coplanar with flange 78. The first region 94 defines a part of the inlet manifold 32 that provides a flow path from the coolant inlet 28 to the inlet openings 36 of the tubular members 16, and the second region 96 defines a part of the outlet manifold 34 that provides a flow path from the outlet openings 38 of the tubular members 16 to the coolant outlet 30. Central notch 98 separates the coolant inlet and coolant outlet 28, 30.

Figure 4:
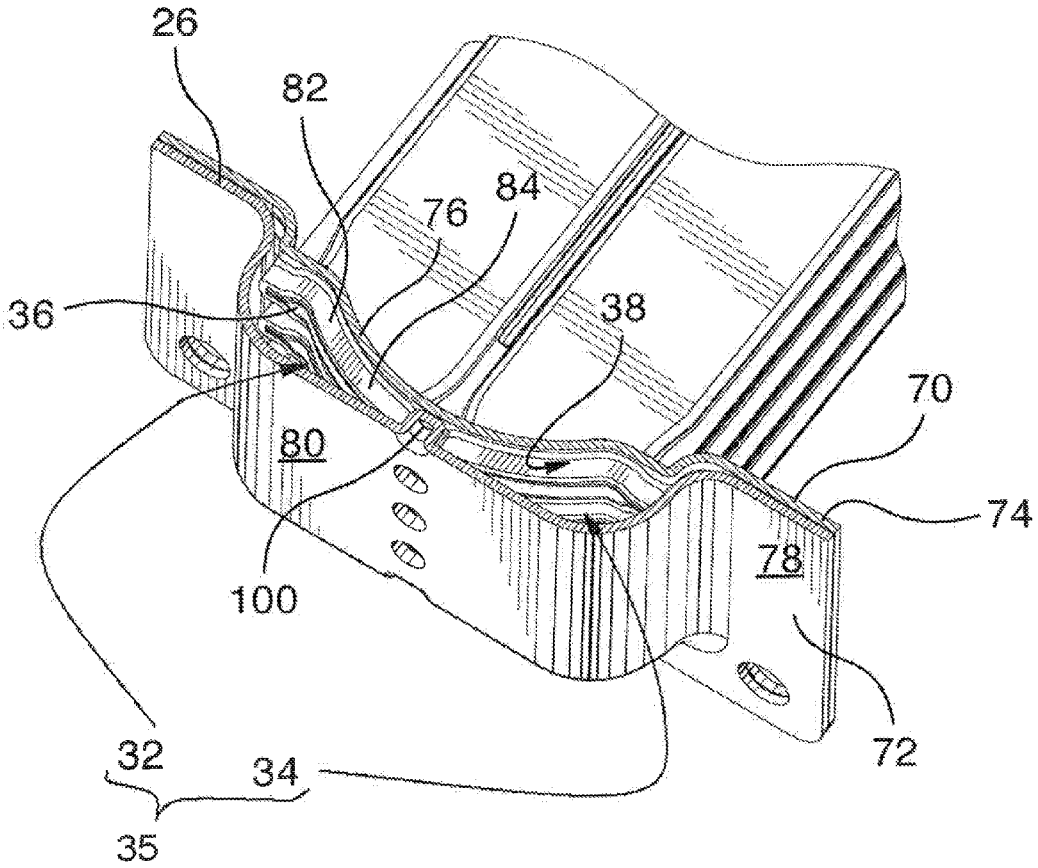
FIG. 4 is a sectional view of part of the heat exchanger taken along lines IV-IV of FIG. 2.
Figure 11:
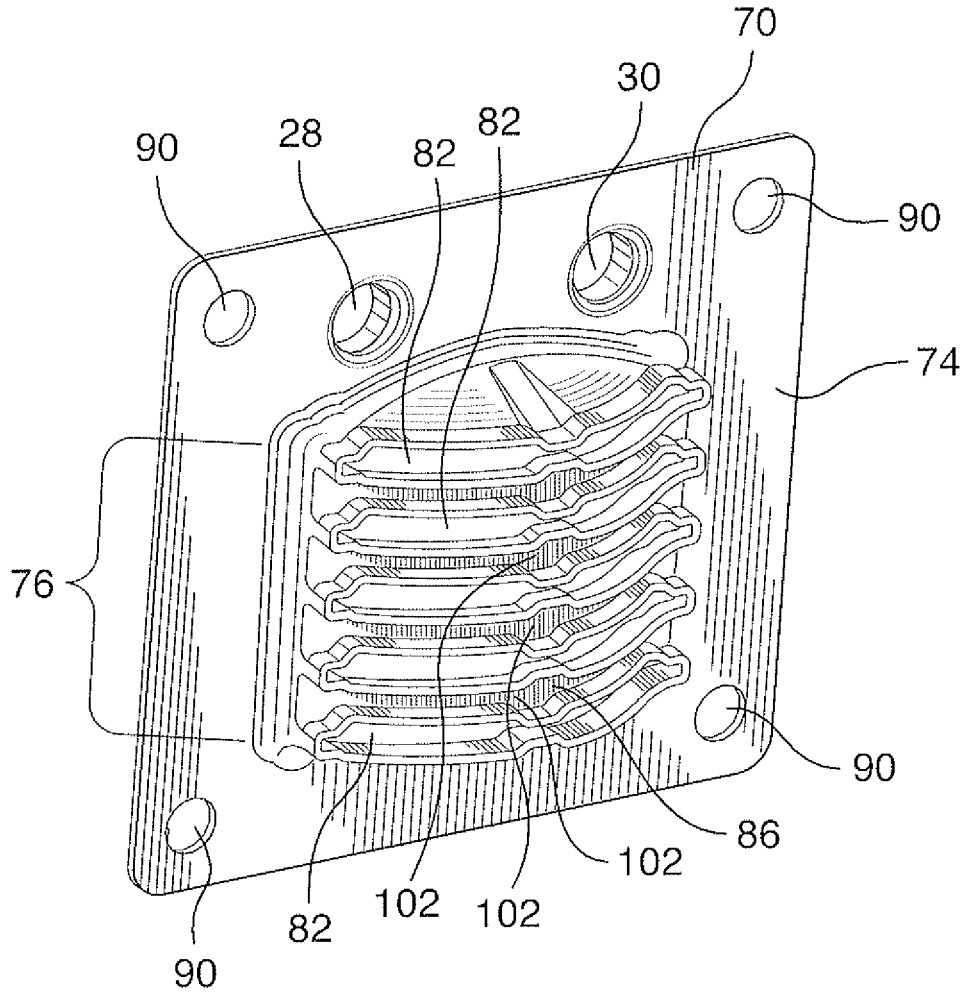
FIG. 11 is a perspective view of a first plate of a tank of the heat exchanger of FIG. 1, showing an inner side of the first plate.
Figure 12:
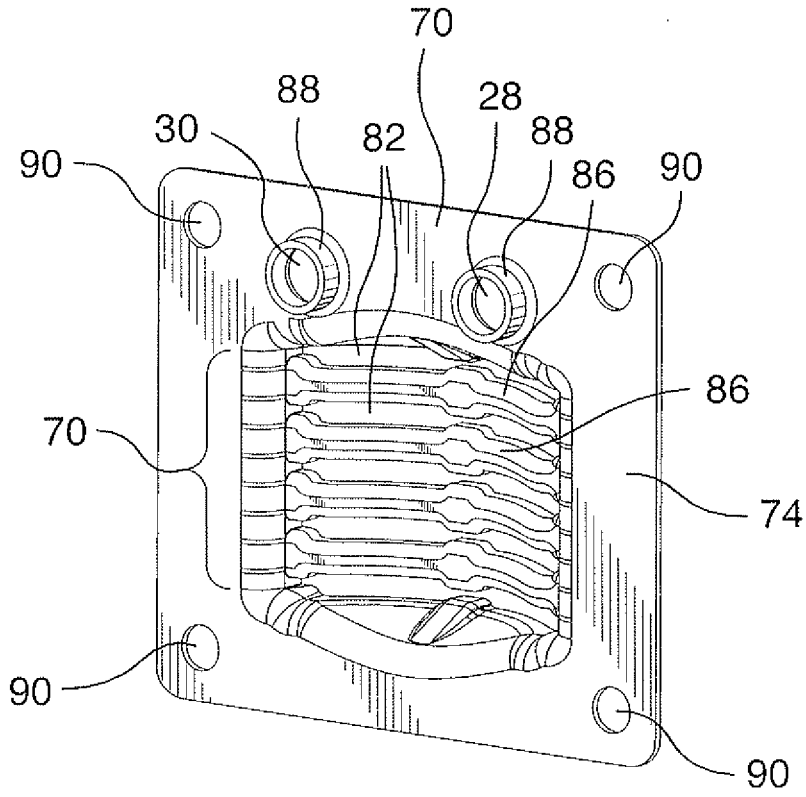
FIG. 12 is a perspective view of the first plate of the tank, showing an outer side of the first plate.

As seen in FIG. 10, a column of spaced apart dimples 100 can be provided and arranged to extend inwardly from the central section 80 of the second tank plate 72. As best seen in FIGS. 3 and 4, each dimple 100 sealingly engages a portion of the central section 76 of the first plate 70 between tubular members 16 in order to divide the tank 26, more specifically, the void interior of the tank 26, into inlet and outlet manifolds 32, 34. In particular, each dimple 100 is configured such that opposite face surfaces of its outer circumference simultaneously engage the inward flanges 84 of two adjacent slots 84 and the end of the dimple 100 engages the wall portion 86 between the two adjacent slots. In this regard, as shown in FIG. 11, the central section 76 of the first plate 70 defines a column of "seats" 102 for receiving and sealingly cooperating with dimples 100.

As shown in the figures, tank plates 70 and 72 are each stamped or otherwise formed from braze-clad aluminum or aluminum alloy plate material, however they could be formed from other materials such as stainless steel, plastics or composites.

It will be appreciated that the inlet and outlet manifolds and openings and passages described above are interchangeable, the requirement being that the first fluid flows from one of the manifolds 32 or 34 through the first set of flow passages 18 to the other of the manifolds 32, 34, and similarly for the second fluid the requirement is that the fluid flow through the second set of flow passages 20.

Figure 15:
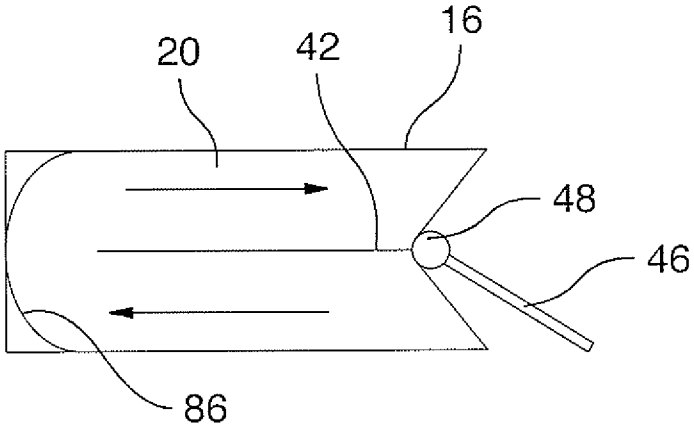
FIGS. 15 and 16 are diagrammatic sectional plan views illustrating flow of the fluid being cooled through two alternative embodiments of the heat exchanger.
Figure 16:
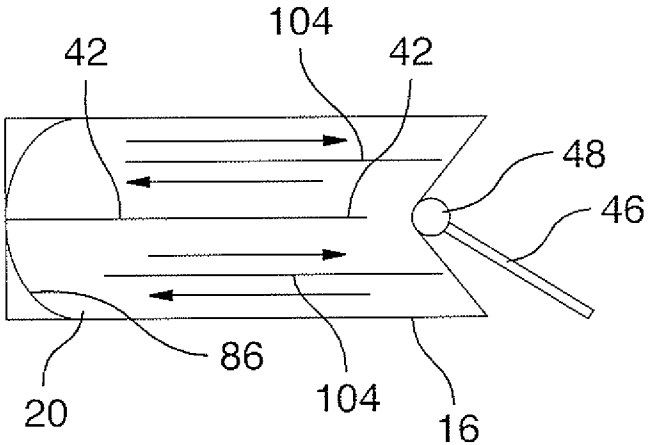

FIGS. 15 and 16 each show diagrammatic representations of alternative exemplary embodiments which are identical to the above-described embodiments except for difference that will be apparent from the drawings and the following description. FIGS. 15 and 16 each illustrate embodiments in which the tubular members 16 are provided with a V-shaped configuration at the exhaust gas header end of the core 12 in order to accommodate the flow diverter flap 46 and provide a smaller heat exchanger package. In the embodiments of FIGS. 15 and 16, internal ribs in tubular members 16 can be used to assist in routing coolant flow around the V-shaped end of the core 12.

As illustrated in FIG. 16, the heat exchanger core 12 need not be limited to just a two pass configuration for either of the first or second fluids—FIG. 16 shows a configuration where the exhaust gas passage 20 has been configured as a four-pass passage example embodiment through repositioning of the central separating wall 42 and the addition of two further separating walls 104.

It will be appreciated that the heat exchanger disclosed in the present application can be adapted to suit various applications.

Figure 17:
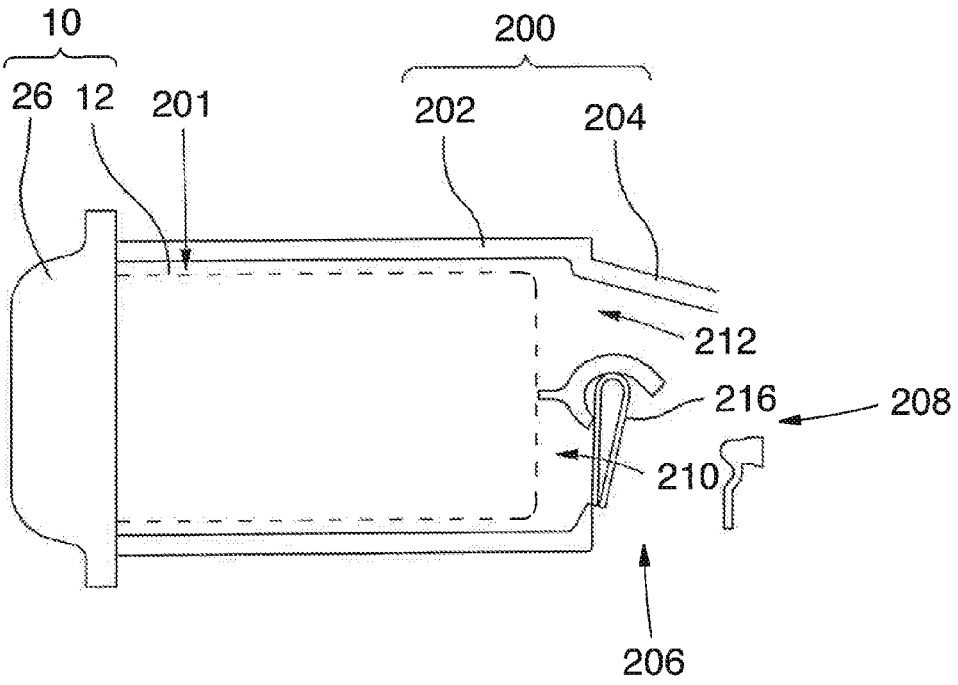
FIG. 17 is a schematic view of another exemplary embodiment of the heat exchanger in use.

For example, one adaptation is illustrated schematically in FIG. 17. In this example, the heat exchanger 10 forms part of a heat exchanger assembly for cooling exhaust gases in an automotive engine. The assembly includes a housing element 200 which is defined by a portion of the exhaust gas valve casting. The element has a first portion 202 which defines an open socket 201. The heat exchanger 10 is positioned such that the pair of manifolds 32,34 are disposed outside the open socket 201 and the heat exchange element 12 (shown in dotted line) is fitted within the open socket 201. The housing element 200 also has a second portion 204. This portion 204 defines a valve housing having an inlet 206 and an outlet 208 and a pair of ports 210,212, and this is arranged such that the U-shaped passages 20 defined between the tubes 16 lead from one of the ports 210, into the open socket 201, and back to the other 212 of the ports. The heat exchange assembly also includes a valve body 216 movable between a bypass position, wherein fluids introduced into the inlet pass 206 directly to the outlet 208, and an active position, wherein fluids introduced are directed past the heat exchange element 12. By housing the heat exchange element 12 inside the casting in this way, a separate shell or housing can be avoided. As well, because the heat exchanger is protected, and need not be self-supporting within the engine compartment, it can be constructed out of thinner gauge material. Both of these tend to reduce costs.

Other variations are possible. Accordingly, the invention should be understood as limited only by the claims, purposively construed.

The invention claimed is:

1. A heat exchanger comprising:

a manifold structure (26) defined by a pair of stacked plates (70,72) which define a void, one of the pair of stacked plates (70) having three or more aperture-surrounding bosses (84) which project into the void and the other (72) of the pair of stacked plates having a plurality of protuberances each of said protuberances engaging between a respective pair of the three or more aperture-surrounding bosses (84), the bosses in said respective pair being adjacent to one another; and a heat exchange element (12) formed of a plurality of stacked plates (22,24), the plurality of stacked plates (22,24) defining a stack of tubes (16) which stack interiorly defines a first plurality of U-shaped passages (18), the passages of said plurality of U-shaped passages (18) being distinct from one another, each of said tubes defining a respective one of the U-shaped passages, each tube (16) being received in plug-fit relation by a respective one of the aperture-defining bosses (84) so that the tubes, the bosses and the protuberances separate the void into a pair of manifolds and so that each of the first plurality of U-shaped passages (18) leads from one of the manifolds (32) of the pair of manifolds to the other (34) of the manifolds of the pair of manifolds.

2. The heat exchanger of claim 1, wherein the heat exchanger is an exhaust gas cooler.

3. The heat exchanger according to claim 2, further comprising a housing element (200) having a first portion (202) defining an open socket (201), the pair of manifolds (32,34) being disposed outside the open socket (201) and the heat exchange element (12) being fitted within the open socket (201).

4. The heat exchanger according to claim 3, wherein:

the housing element (200) has a second portion (204) defining a valve housing having an inlet (206) and an outlet (208) and a pair of ports (210,212); and, the plurality of stacked plates (22,24) define, in combination with the first portion (202) of the housing element, a plurality of U-shaped exhaust gas passages (20) interleaved between the plurality of U-shaped coolant passages (18), each of the plurality of U-shaped exhaust gas passages (20) leading from the one of the ports (210), into the open socket (201), and back to the other (212) of the ports.

5. The heat exchanger according to claim 4, further comprising a valve body (216) movable between a bypass position, wherein exhaust gas introduced into the inlet (206) pass directly to the outlet (208), and an active position, wherein exhaust gas introduced is directed past the heat exchange element (12).

6. The heat exchanger according to claim 1, wherein a tank defines the pair of manifolds, the tank having a plurality of wall portions each having a first side facing at least one of manifolds of the pair of manifolds and an opposite side facing a respective one of the U-shaped passages.

7. A heat exchange assembly including:

a heat exchanger, the heat exchanger including a manifold structure (26) defined by a pair of stacked plates (70,72) which define a void, one of the pair of stacked plates (70) having a plurality of aperture-surrounding bosses (84) which project into the void and the other (72) of the pair of stacked plates having a plurality of protuberances each engaging between a respective pair of adjacent bosses (84); and a heat exchange element (12) formed of a plurality of stacked plates (22,24), the plurality of stacked plates (22,24) defining a stack of tubes (16) which stack interiorly defines a first plurality of U-shaped passages (18), each of said tubes defining a respective one of the U-shaped passages, each tube (16) being received in plug-fit relation by a respective one of the aperture-defining bosses (84) so that the tubes, the bosses and the protuberances separate the void into a pair of manifolds and so that each of the first plurality of U-shaped passages (18) leads from one of the manifolds (32) of the pair of manifolds to the other (34) of the manifolds of the pair of manifolds; and a housing element (200) having a first portion (202) defining an open socket (201), the pair of manifolds (32,34) being disposed outside the open socket (201) and the heat exchange element (12) being fitted within the open socket (201).

8. The heat exchange assembly according to claim 7, wherein:

the one (70) of the pair of stacked plates has a pair of outer bosses (88) which bosses project from the void, each of the bosses of the pair of outer bosses leading into a respective one of the manifolds (32,34);

the pair of stacked plates and the plurality of stacked plates have peripheral planar sections (74,78) which can be stacked together to define a flange for mounting to the housing element (200); and the other (72) of the pair of stacked plates has a central hollow in which the protuberances (100) are formed.

9. The heat exchange assembly according to claim 7, wherein:

the housing element (200) has a second portion (204) defining a valve housing having an inlet (206) and an outlet (208) and a pair of ports (210,212); and the plurality of stacked plates (22,24) define, in combination with the first portion (202) of the housing element, a second plurality of U-shaped passages (20) interleaved between the first plurality of U-shaped passages (18), each of the second plurality of U-shaped passages (20) leading from the one of the ports (210), into the open socket (201), and back to the other (212) of the ports.

10. The heat exchange assembly according to claim 9, further comprising a valve body (216) movable between a bypass position, wherein fluids introduced into the inlet pass (206) directly to the outlet (208), and an active position, wherein fluids introduced are directed past the heat exchange element (12).

* * * * *